US008305164B1

(12) United States Patent
Jachowski

(10) Patent No.: US 8,305,164 B1
(45) Date of Patent: Nov. 6, 2012

(54) FREQUENCY-AGILE FREQUENCY-SELECTIVE VARIABLE ATTENUATOR

(75) Inventor: Douglas R Jachowski, Alexandria, VA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 240 days.

(21) Appl. No.: 12/797,003

(22) Filed: Jun. 9, 2010

Related U.S. Application Data

(60) Provisional application No. 61/185,218, filed on Jun. 9, 2009.

(51) Int. Cl.
*H01P 1/20* (2006.01)
*H01P 5/18* (2006.01)
*H01P 1/212* (2006.01)

(52) U.S. Cl. ..... 333/205; 333/81 A; 333/110; 333/174; 333/132

(58) Field of Classification Search ..... 333/204, 333/205, 174–177, 109, 110, 126, 129, 132, 333/81 A; 327/556
See application file for complete search history.

(56) References Cited

U.S. PATENT DOCUMENTS

| | | | |
|---|---|---|---|
| 2,035,258 | A | 3/1936 | Bode |
| 3,142,028 | A | 7/1964 | Wanselow |
| 4,262,269 | A | 4/1981 | Griffin et al. |
| 4,577,168 | A | 3/1986 | Hartmann |
| 4,694,266 | A | 9/1987 | Wright |
| 5,187,460 | A | 2/1993 | Forterre et al. |
| 5,339,057 | A | 8/1994 | Rauscher |
| 5,525,945 | A | 6/1996 | Chiappetta et al. |
| 5,721,521 | A | 2/1998 | Drabeck et al. |
| 5,781,084 | A | 7/1998 | Rhodes |
| 6,020,783 | A | 2/2000 | Coppola |
| 6,636,128 | B2 | 10/2003 | Rauscher |
| 7,323,955 | B2 | 1/2008 | Jachowski |

FOREIGN PATENT DOCUMENTS

| | | |
|---|---|---|
| WO | WO-95/15018 | 6/1995 |

OTHER PUBLICATIONS

H. Matsumura & Y. Konishi, "An active microwave filter with dielectric resonator," *1979 IEEE MTT-S Int. Microwave Symp. Digest*, pp. 323-325, Jun. 1979.

T. Nishikawa, Y. Ishikawa, J. Hattori, & K. Wakino, "Dielectric receiving filter with sharp stopband using an active feedback resonator method for cellular base stations" *IEEE Trans. Microwave Theory Tech.*, vol. 37, pp. 2074-2079, Dec. 1989.

D. R. Jachowski, "Passive enhancement of resonator Q in microwave notchfilters," IEEE MTT-S Int. Microw. Symp. Dig., pp. 1315-1318, Jun. 2004.

(Continued)

*Primary Examiner* — Stephen Jones
(74) *Attorney, Agent, or Firm* — Amy L. Ressing; L. George Legg

(57) ABSTRACT

A method of tuning the stopband attenuation of an absorptive bandstop filter having at least a first and second resonator, where the first resonator includes a first tuning element that exhibits a first resonant frequency, the second resonator includes a second tuning element that exhibits a second resonant frequency, and the tuning elements are used to adjust the corresponding resonant frequencies, includes 1) adjusting the first resonant frequency using the first tuning element; and 2) adjusting the second resonant frequency using the second tuning element, such that both resonant frequencies are coordinated to obtain a selected stopband attenuation level and to thus realize a frequency-selective variable attenuator.

7 Claims, 4 Drawing Sheets

OTHER PUBLICATIONS

A. C. Guyette, I. C. Hunter, R. D. Pollard, and D. R. Jachowski, "Perfectly-matched bandstop filters using lossy resonators," IEEE MTT-S Int. Microw. Symp. Dig., Jun. 2005.

D. R. Jachowski, "Cascadable lossy passive biquad bandstop filter," IEEE MTT-S Int. Microw. Symp. Dig., pp. 1213-1316, Jun. 2006.

D. R. Jachowski, "Synthesis of lossy reflection-mode bandstop filters," in Proc. Int. Workshop on Microwave Filters, CNES, Toulouse, France, Oct. 16-18, 2006.

P. W. Wong, I. C. Hunter, and R. D. Pollard, "Matched Bandstop Resonator with Tunable K-Inverter," Proc. 37th Eur. Microw. Conf., pp. 664-667, Oct. 2007.

I. Hunter, A. Guyette, R. D. Pollard, "Passive microwave receive filter networks using low-Q resonators," IEEE Microw. Mag., pp. 46-53, Sep. 2005.

Sachihiro Toyoda, "Notch filters with variable center frequency and attenuation," IEEE MTT-S Int. Microw. Symp. Dig., Jun. 1989.

B. Sheleg and B. E. Spielman, "Broadband directional couplers using microstrip with dielectric overlays," IEEE Trans. Microw. Theory Tech., pp. 1216-1220, Dec. 1974.

D. R. Jachowski, "Compact, frequency-agile, absorptive bandstop filters", 2005 IEEE MTT-S Int. Microwave Symp Digest, pp. 513-516 (Jun. 2005).

| | |
|---|---|
| $C(v) = \dfrac{6.660}{1-\dfrac{v}{1.17}}$ [pF] | $R(v)\begin{cases} 0.939091 - 0.044545v, \text{ for } -20V \le v \le -7.847V \\ 1.783 + 0.063v, \text{ for } -7.847V \le v \le -1V \\ 1.865 + 0.145v, \text{ for } -1V \le v \le 0V \end{cases}$ [Ω] |

FREQUENCY-AGILE FREQUENCY-SELECTIVE VARIABLE ATTENUATOR

CROSS-REFERENCE TO RELATED APPLICATIONS

This Application claims the benefit of U.S. Provisional Application 61/185,218 filed on Jun. 9, 2009, and incorporated herein by reference.

FIELD OF THE INVENTION

The invention is directed to a means of creating a frequency-agile frequency-selective variable attenuator, or, from another point of view, a method of tuning the stopband attenuation level of a frequency-agile absorptive bandstop filter that preserves stopband bandwidths.

BACKGROUND OF THE INVENTION

Multi-function receivers for communication and navigation, as well as single-function receivers for communications, surveillance, or reconnaissance, are at times exposed to incident signals of interest having substantially different power levels. Allowing higher level signals into the receiver front-end unattenuated can compromise receiver performance and inhibit or interfere with the reception of lower level signals. Particularly strong signals could even drive the amplifier in a receiver front end into compression or saturation as discussed above—distorting, compressing, and masking weaker signals and thereby desensing the receiver.

The conventional solutions to this dilemma are to insert a fixed or variable resistive attenuator, or a diode limiter, prior to the first amplifier in the receiver front-end in order to limit the maximum power level that the amplifier can be exposed to. While such solutions can prevent larger signals from compressing or saturating the amplifier, they indiscriminately attenuate signal power across a broad band of frequencies—unavoidably attenuating weaker signals as well as stronger signals, raising the receiver noise floor, and introducing additional sources of signal distortion that significantly degrade the dynamic range of the receiver.

An alternative, better, solution would be to introduce a frequency selective bandstop filter, with a fixed level of stopband attenuation, to attenuate stronger signals within its stopband and leave weaker signals outside of its stopband unaffected. Further, such bandstop filters should be frequency agile so that they can be tuned to different frequencies to adapt to changes in the operating frequency of the stronger signals. Conventional bandstop filters suffer significant performance degradation when tuned over a substantial frequency range, making conventional bandstop filter approaches undesirable for realizing frequency-agile frequency-selective attenuators. Recently, compact narrowband absorptive bandstop, or "notch", filters have been demonstrated that can be tuned over a substantial frequency range without significant performance degradation. Descriptions of such absorptive filters may be found in the following papers, each of which is incorporated herein by reference: D. R. Jachowski, "Passive enhancement of resonator Q in microwave notch filters," IEEE MTT-S Int. Microw. Symp. Dig., pp. 1315-1318, June 2004 ("Jachowski-1"); D. R. Jachowski, "Compact, frequency-agile, absorptive bandstop filters," IEEE MTT-S Int. Microw. Symp. Dig., June 2005 ("Jachowski-2"); A. C. Guyette, I. C. Hunter, R. D. Pollard, and D. R. Jachowski, "Perfectly-matched bandstop filters using lossy resonators," IEEE MTT-S Int. Microw. Symp. Dig., June 2005; D. R. Jachowski, "Cascadable lossy passive biquad bandstop filter," IEEE MTT-S Int. Microw. Symp. Dig., pp. 1213-1316, June 2006; D. R. Jachowski, "Synthesis of lossy reflection-mode bandstop filters," in Proc. Int. Workshop on Microwave Filters, CNES, Toulouse, France, 16-18 Oct. 2006; and P. W. Wong, I. C. Hunter, and R. D. Pollard, "Matched Bandstop Resonator with Tunable K-Inverter," Proc. 37th Eur. Microw. Conf., pp. 664-667, October 2007. While, due to their relative simplicity, "first-order" absorptive filters tend to be the most practical to use in frequency-agile applications, the attenuation characteristics of such first-order sections alone tend to lack sufficient stopband bandwidth to be of practical use. Consequently, first-order sections are cascaded to realize practical stopband bandwidths, e.g. as described in Jachowski-2 and in I. Hunter, A. Guyette, R. D. Pollard, "Passive microwave receive filter networks using low-Q resonators," *IEEE Microw. Mag.,* pp. 46-53, September 2005, incorporated herein by reference. An absorptive notch filter approach may then be suitable for realizing frequency-agile frequency-selective attenuators.

An even better solution than a frequency-agile frequency-selective attenuator would be one with variable attenuation, so that the attenuation of stronger signals can be tailored to optimize receiver dynamic range. A conventional bandstop filter approach to realizing this variable attenuation function is undesirable because the bandwidth of a conventional bandstop filter is dependent on the level of its stopband attenuation, so that varying one varies the other. There has also been no known means of adjusting the stopband attenuation level of frequency-agile absorptive bandstop filters without undesirably altering their stopband bandwidth or other performance parameters, as for example in Sachihiro Toyoda, "Notch filters with variable center frequency and attenuation," IEEE MTT-S Int. Microw. Symp. Dig., June 1989. Consequently, the attenuation of stronger signals cannot currently be tailored to their specific power levels and receiver dynamic range is still compromised.

It would therefore be desirable to provide a new method of tuning a frequency-agile absorptive bandstop filter as a means of realizing a frequency-agile frequency-selective variable attenuator, such that stopband attenuation level can be varied while preserving stopband bandwidth, low passband insertion loss, and substantial frequency selectivity.

BRIEF SUMMARY OF THE INVENTION

According to the invention, a method of tuning the stopband attenuation of an absorptive bandstop filter having at least a first and second resonator, where the first resonator includes a first tuning element that exhibits a first resonant frequency, the second resonator includes a second tuning element that exhibits a second resonant frequency, and the tuning elements are used to adjust the corresponding resonant frequencies, includes 1) adjusting the first resonant frequency using the first tuning element; and 2) adjusting the second resonant frequency using the second tuning element, such that both resonant frequencies are coordinated to obtain a selected stopband attenuation level and to thus realize a frequency-selective variable attenuator.

The invention in one embodiment is directed to tuning the attenuation of a "third-order", six-resonator, microstrip absorptive bandstop filter—composed of a properly phased cascade of three "first-order" stages—with a 22% frequency tuning range and a 20 dB stopband-attenuation tuning range, by tuning the varactor capacitance (i.e., resonator frequencies) rather than FET resistance, e.g. as described in S.

Toyoda, "Notch filters with variable center frequency and attenuation," IEEE MTT-S Int. Microw. Symp. Dig., pp. 595-598, June 1989.

The invention is an extension of the circuit in Jachowski-2 that enables tuning of the operating frequency of an absorptive notch filter. Although it is conventionally possible to tune attenuation by tuning bandwidth, the new approach allows tuning of stopband attenuation while preserving both stopband and passband bandwidths. This new circuit component functions as a frequency-agile frequency-selective variable attenuator.

DETAILED DESCRIPTION OF THE INVENTION

Figure 1A:
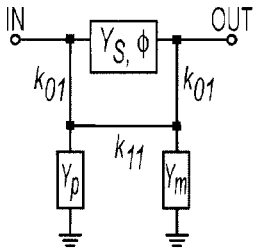
FIG. 1A is an equivalent circuit of a "first-order", two-resonator, absorptive bandstop filter with tunable stopband attenuation.

The invention is directed to a method of tuning absorptive bandstop filters—such as those disclosed in U.S. Pat. No. 7,323.955. Douglas R. Jachowski, issued Jan. 29, 2008, and incorporated herein by reference—so as to realize a frequency-agile frequency-selective variable attenuator.

Conventional bandstop filters reflect stopband signals, and resonator loss tends to reduce and limit their stopband attenuation and band-edge selectivity. In Jachowski-2, a two-resonator bandstop filter topology, termed an "absorptive- pair", is described that, at least to some extent, absorbs stopband signals—with resonator loss limiting minimum bandwidth rather than stopband attenuation. One of many possible electrically-equivalent circuit schematics of an absorptive pair bandstop filter is given in FIG. 1A, in which ideal (frequency invariant) admittance inverters $k_{01}$ couple lossy lumped-element resonators, with admittances $Y_p$ and $Y_m$, to the ends of a phase shift element of characteristic admittance $Y_s$ and frequency-invariant phase shift $\phi$, while ideal admittance inverter $k_{11}$ directly couples the two resonators, and where FIG. 1B provides the relevant definitions. Although a more accurate analysis would require frequency dependent representations of couplings and phase shifts, including frequency dependence would lead to more complicated results which obscure understanding. FIG. 2 shows representative transmission responses of the highpass prototype of the bandstop filter of FIG. 1, that is, simulated responses of an absorptive-pair highpass prototype filter illustrating tunable attenuation levels of 10, 20, 30, and 40 dB at $\omega'=0$, assuming $Y_s=1$, $k_{11}=g=1$, $q_u=2$, and (from equation 10, below) $k_{01}=\sqrt{Y(k_{11}^2+g^2+b_o^2)/(k_{11}\sin)}$ with $b_o=0.326$.

For the idealized absorptive-pair notch filter in FIG. 1:

$$Y_p=g_p(1+jQ_p\alpha_p) \tag{1}$$

$$Y_m=g_m(1+jQ_m\alpha_m) \tag{2}$$

where $$Q_p=2\pi f_pC_p/g_p,\ Q_m=2\pi f_mC_m/g_m,$$

$$\alpha_p=(f/f_p-f_p/f),\ \alpha_m=(f/f_m-f_m/f),$$

$$f_p=1/(2\pi\sqrt{L_pC_p}),\ \text{and}\ f_m=1/(2\pi\sqrt{L_mC_m}).$$

Although the phase shift element could be implemented in many ways, such as by a parallel-coupled-line phase shifter or lowpass or highpass filter, here a transmission line of admittance $Y_s$ and electrical length $\phi$ at filter center frequency $f_o$ is used. The reciprocal asymmetric network in FIG. 1 may be analyzed using ABCD parameter analysis (e.g. as described in J. A. Dobrowolski. Introduction to Computer Methods for Microwave Analysis and Design, (Artech: 1991) ("Dobrowolski"), pp. 7-14, 68-73]. Assuming equal source and load impedances, $R_S=R_L=Z_s=1/Y_s$, the two-port scattering parameter $S_{21}$ is given by Dobrowolski, p. 52, $$S_{21}=\frac{2Z_s}{B+(A+D)Z_s+CZ_s^2} \tag{3}$$

where $$A=(Y_s(k_{11}^2+Y_pY_m)\cos(\phi)+jk_{01}^2Y_p\sin(\phi))/d$$

$$D=(Y_s(k_{11}^2+Y_pY_m)\cos(\phi)+jk_{01}^2Y_m\sin(\phi))/d$$

$$B=j((k_{11}^2+Y_pY_m)\sin(\phi))/d$$

$$C=(k_{01}^2Y_s(Y_p+Y_m)\cos(\phi)+j((k_{01}^2+Y_s^2(k_{11}^2+Y_pY_m))\sin(\phi)-2k_{01}^2k_{11}Y_s))/d$$

$$d=Y_s(k_{11}^2+Y_pY_m)-k_{01}^2k_{11}\sin(\phi). \tag{4}$$

Figure 3:
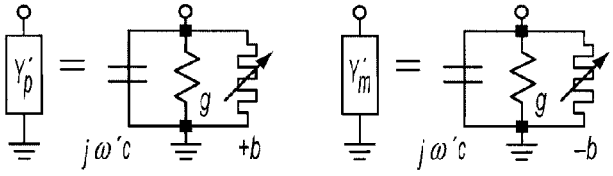
FIG. 3 are the definitions for admittances $Y_p$! and $Y_m$', which replace $Y_p$ and $Y_m$ in FIG. 1 to form the first-order highpass prototype.

To better understand the behavior of the absorptive bandstop filter it is most convenient to work with its high-pass prototype, with a minimum of attenuation $L_o$ at radian frequency ω=0. The highpass prototype can be represented by FIG. 1A, with $Y_p$ and $Y_m$ replaced by $$Y_p'=g(1+j(\omega' q_u+b/g)) \text{ and} \tag{5}$$

$$Y_m'=g(1+j(\omega' q_u-b/g)) \tag{6}$$

as shown in FIG. 3, where b is a variable frequency-invariant susceptance, g is a conductance, ω' is the normalized highpass prototype radian frequency, $q_u=\omega_1'c/g$ is the unloaded Q of the shunt admittances of the highpass prototype, c is a capacitance, and $\omega_1'=1$ is the band-edge radian frequency at which the attenuation is $L_s$.

In terms of s'=jω', $S_{21}$ is given by $$S_{21}(j\omega') = e^{-j\phi}\frac{(s'-s'_{z1})(s'-s'_{z2})}{(s'-s'_{p1})(s'-s'_{p2})} \tag{7}$$

with zeros at $$s'_{z1,z2} = -\left(\frac{1}{q_u}\right)\left(1 \pm \frac{1}{gY_t}\sqrt{Y_t k_{01}^2 k_{11}\sin[\phi] - Y_t^2(k_{11}^2+b^2)}\right) \tag{8}$$

and poles at $$s'_{p1,p2} = \frac{-\left(k_{01}^2 + 2gY_t \pm e^{-j\phi}\sqrt{(k_{01}^2 + j2k_{11}Y_t e^{j\phi})^2 - (2bY_t e^{j\phi})^2}\right)}{2gY_t q_u}. \tag{9}$$

Figure 1B:
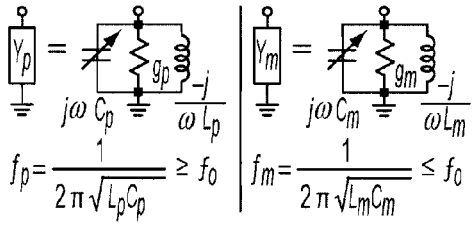
FIG. 1B shows the definitions for the admittances $Y_p$ and $Y_m$ of the bandstop filter in FIG. 1A.
Figure 2:
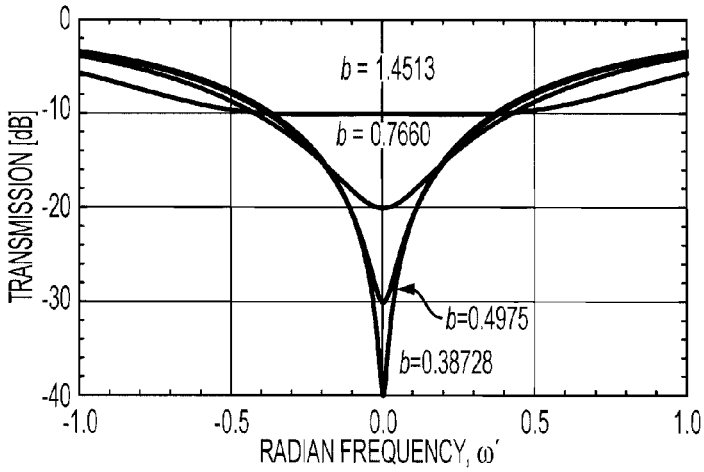
FIG. 2 shows representative transmission responses of the highpass prototype of the bandstop filter of FIG. 1.

Using Equations (3)-(9), equating the numerator of $S_{21}$ to zero at ω'=0, and solving provides the design criteria that gives the absorptive highpass prototype filter of FIGS. 1A and 3 infinite attenuation at ω'=0 (Jachowski-2):

$$k_{01} = \sqrt{Y_t\frac{k_{11}^2+g^2+b^2}{k_{11}\sin(\phi)}} \tag{10}$$

A similar analysis of the bandstop filter of FIG. 1 using Equations (1)-(4) and $S_{21}|_{f=f_0}=0$ gives a design criteria of $$k_{01} = \sqrt{Y_t\frac{k_{11}^2+g_m g_p+g_m g_p Q_m Q_p(f_p^2-f_o^2)(f_o^2-f_m^2)/f_o^2}{k_{11}\sin(\phi)}} \tag{11}$$

where the frequency of infinite stopband attenuation is $$f_o = \sqrt{f_m f_p\frac{Q_m f_m + Q_p f_p}{Q_m f_p + Q_p f_m}}. \tag{12}$$

Assuming $g \approx g_m \approx g_p$ and $Q_o \approx Q_m \approx Q_p$, Equation (12) becomes $$f_o \approx \sqrt{f_m f_p}, \tag{13}$$

and from Equations (10) and (11) the resonant frequencies are $$f_p \cdot f_m \approx f_o\left(\sqrt{1+\left(\frac{b}{2gQ_o}\right)^2} \pm \frac{b}{2gQ_o}\right) \tag{14}$$

and the prototype's frequency-invariant susceptance b is proportional to the difference in resonant frequencies $f_p$, $f_m$ of the two resonators in the corresponding bandstop filter:

$$b \approx (f_p - f_m)\frac{gQ}{f_o} \tag{15}$$

Figure 4:
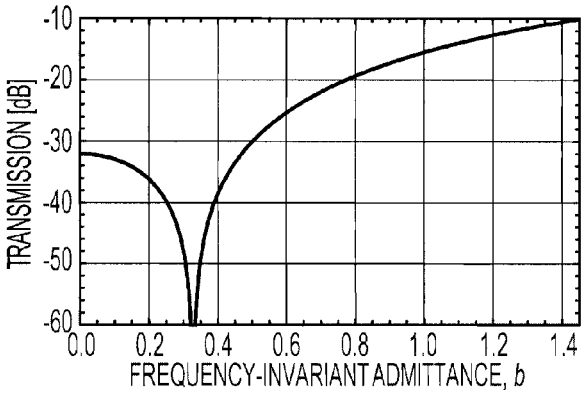
FIG. 4 is a plot of transmission versus admittance for the absorptive-pair highpass prototype of FIGS. 1 and 3.

Using Equations (8) and (9), and letting $k_{01}$ in Equation (10) be a constant with $b=b_o=0.326$, FIGS. 2 and 4 illustrate the dependence of the highpass prototype's stopband attenuation level on b, and, by analogy, the dependence of the corresponding bandstop filter's stopband level on $(f_p-f_m)$ . . . with FIG. 4 being a plot of transmission versus b for the absorptive-pair highpass prototype at ω'=0, assuming $Y_s=1$, $k_{11}=g=1$, $q_u=2$, and (from equation 10) $k_{01}=\sqrt{Y(k_{11}^2+g^2+b_o^2)/(k_{11}\sin)}$ with $b_o=0.326$.

Figure 5A:
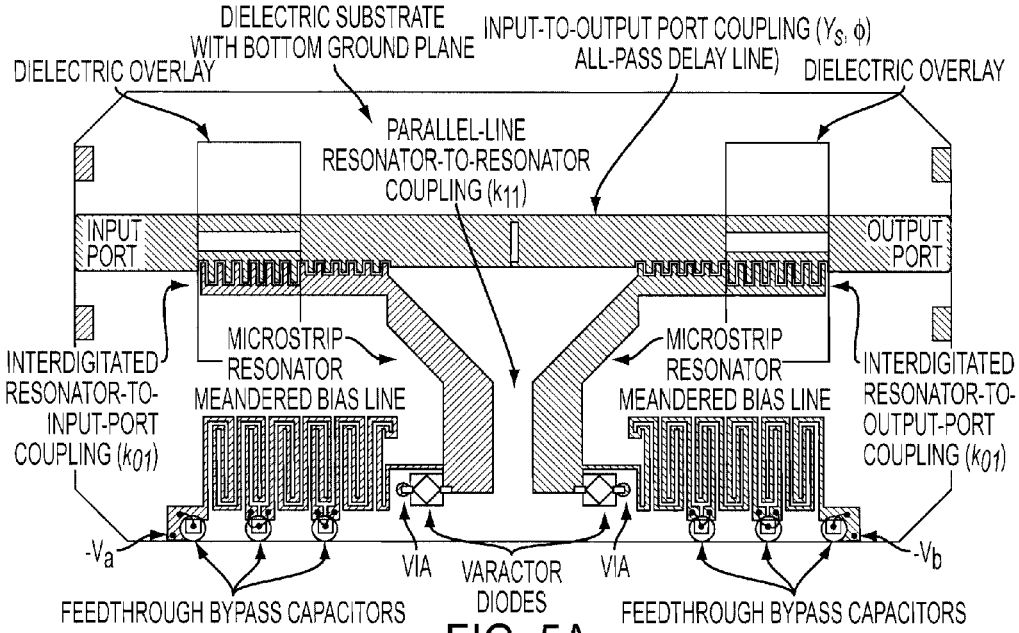
FIG. 5A is an annotated layout, and FIG. 5B a photo, of the frequency-agile first-order, absorptive-pair filter with tunable attenuation of FIG. 1 with dielectric overlays used to increase couplings and varactor diodes used to implement the tuning method according to the invention.
Figure 5B:
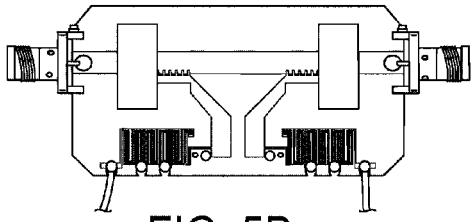
Figure 6:
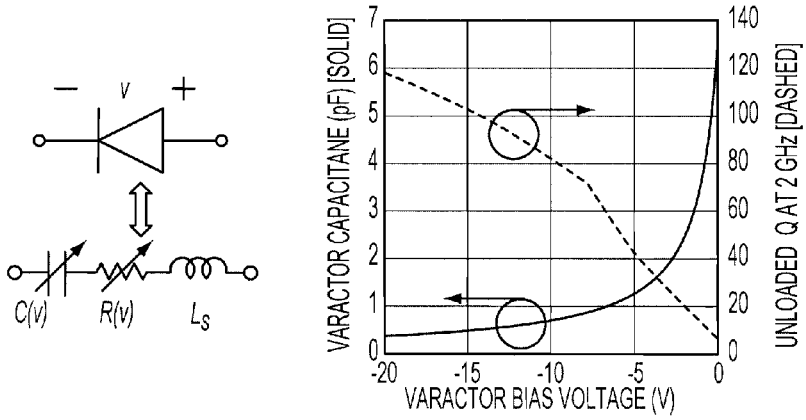
FIG. 6 is an equivalent circuit model, and corresponding plot of the capacitance versus bias voltage characteristic and unloaded Q versus bias voltage characteristic, of the commercially-available varactor diode used to implement the tuning method of the invention.

To demonstrate the capabilities of the absorptive pair, an improved implementation of the frequency-agile bandstop filter demonstrated in Jachowski-2 was designed using an iterative-analysis, manual-optimization approach, resulting in the layout of FIG. 5A and the manufactured unit of FIG. 5B, in which dielectric overlays are used to increase certain couplings as described in B. Sheleg and B. E. Spielman, "Broadband directional couplers using microstrip with dielectric overlays," IEEE Trans. Microw. Theory Tech., pp. 1216-1220, December 1974 ("Sheleg et al."). The design process began by (a) characterizing the microstrip loss on the Rogers' RO4003 substrate (60-mil thick, 3.38 dielectric constant, 0.0021 dielectric loss tangent, 0.034 mm copper) by matching measurements of a conventional notch filter (with a single, open-circuited, half-wavelength resonator) to corresponding microstrip models in commercially-available circuit and 3D planar electromagnetic (EM) field simulators (by adjusting conductor resistivity) and (b) extracting the series-resistor-inductor-capacitor (series-RLC) model of the varactors, in FIG. 6, from two-port s-parameter measurements of a 50Ω microstrip line with a shunt-connected reverse-biased varactor diode to ground. In particular, FIG. 6 describes the equivalent circuit model of the reverse-biased Metelics MGV-125-24-E25 GaAs hyperabrupt varactor diode, with $L_s$=1.327 nH. Then a microstrip circuit model, topologically representative of FIG. 1, was iteratively-optimized at three operating frequencies: a lowest tuned frequency of about 1.5 GHz, a highest tuned frequency of about 2.5 GHz, and a mid-band tuned frequency of 2 GHz. Experience with Jachowski-2 indicated that the design should constrain the resonant frequencies of the resonators to be equal at the target lowest-tuned frequency and constrain one of the two bias voltages to be the highest acceptable voltage at the target highest-tuned frequency.

Once the circuit model's attenuation was greater than 60 dB at each of the three operating frequencies for some set of bias voltage pairs, ad-hoc lowpass varactor bias networks. comprised of three sections of meandered (electrically quarter-wavelength) microstrip were added, with intervening 20 pF shunt capacitors to ground. After the circuit had been re-optimized, subcircuits were gradually replaced by s-parameter files of corresponding EM-modeled microstrip layouts, and further re-optimized, until the entire circuit model (except varactors and capacitors) had been replaced by a collection of s-parameter files corresponding to different portions of EM-modeled microstrip layouts (dielectric overlay sections, center section, bias lines, and varactor grounding vias).

Figure 7A:
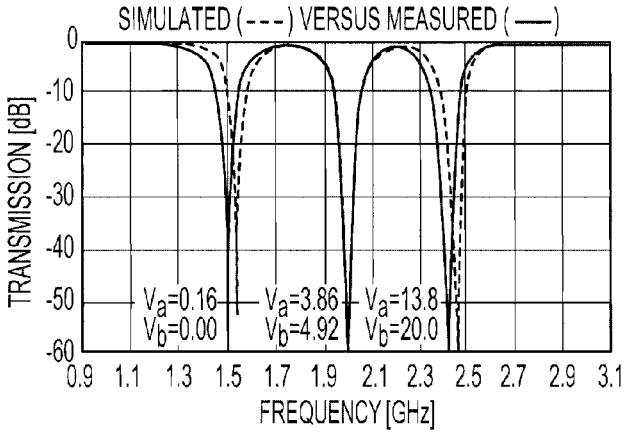
FIG. 7A shows superimposed plots of the predicted and measured transmission of the filter of FIG. 5 tuned to 3 different frequencies.
Figure 7B:
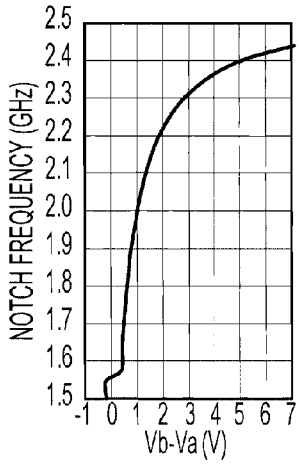
FIG. 7B shows the measured notch frequency versus difference in the reverse-bias voltages applied to the two varactors of the filter of FIG. 5.

It was beneficial to keep the varactor ground vias as far apart as practical to minimize their coupling, to design the isolation level of the bias networks to be similar to the maximum attenuation of the filter (about 60 dB), and to mount the bypass capacitors vertically as substrate feedthroughs to minimize their inductance to ground and keep the associated series resonances above the frequency band of interest. Simulations and measurements of the filter's performance are compared in FIG. 7A and a plot of measured maximum-attenuation frequency versus the difference between the two bias voltages is given in FIG. 7B—corroborating the theory discussed above.

Figure 8:
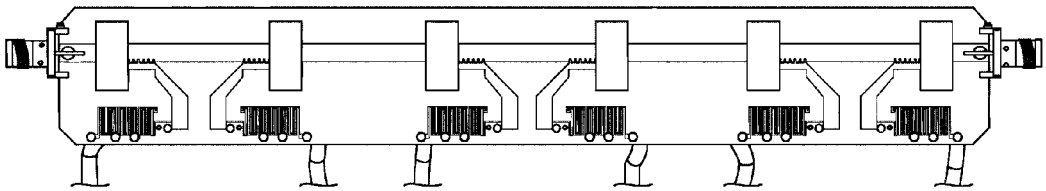
FIG. 8 is a photograph of the frequency-agile, third-order absorptive-pair bandstop filter with tunable attenuation according to the invention.
Figure 9:
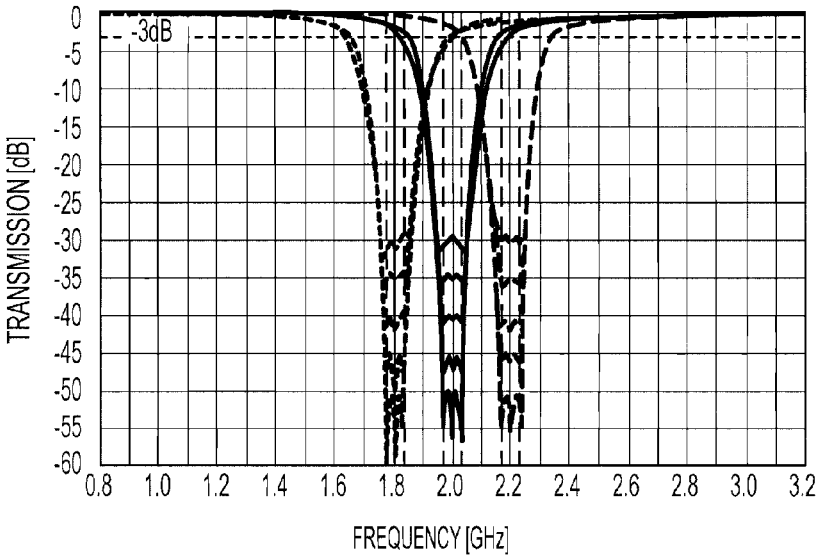
FIG. 9 are superimposed plots of the measured transmission of the bandstop filter of FIG. 8 demonstrating both tunable operating frequency and tunable stopband attenuation applying the tuning method according to the invention.
Figure 10A:
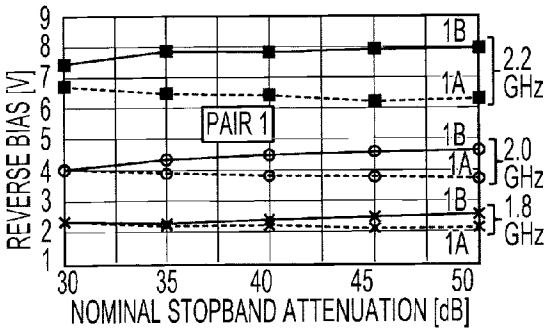
FIG. 10 are plots of stopband attenuation and operating frequency as a function of bias voltages for the varactors of the filter of FIG. 8 for the filter's (a) first, (b) second, and (c) third absorptive-pair stage, as well as plots relating difference in bias voltages for specified pairs of varactors to stopband attenuation at different operating frequencies in (d)-(f) applying the tuning method according to the invention.
Figure 10B:
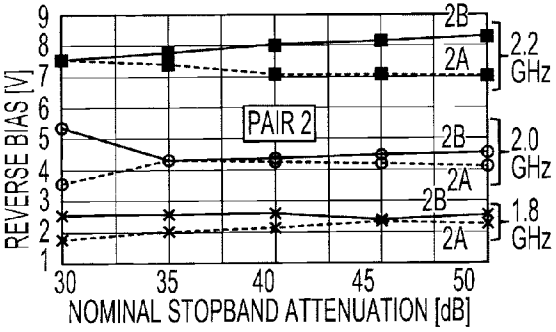
Figure 10C:
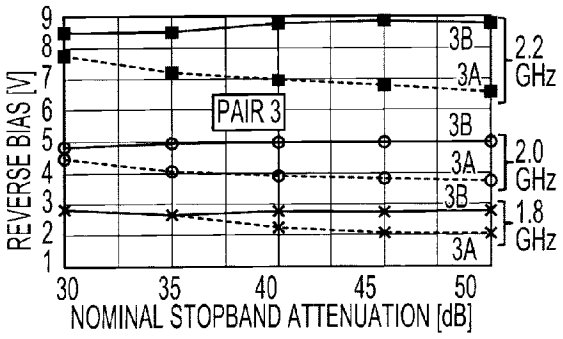
Figure 10D:
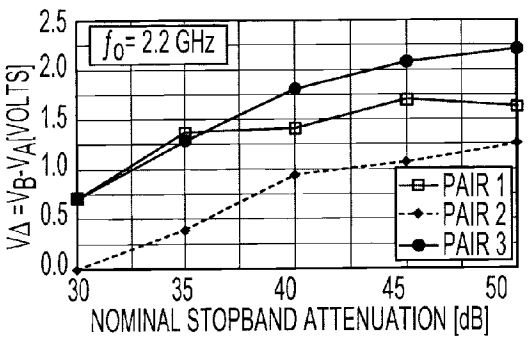
Figure 10E:
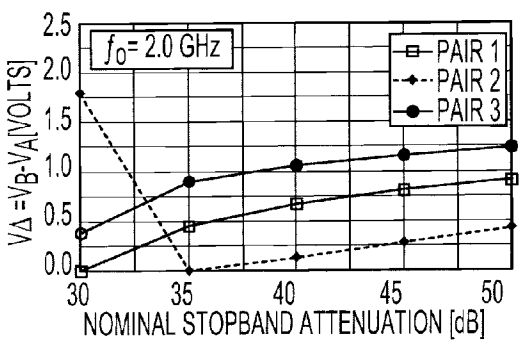
Figure 10F:
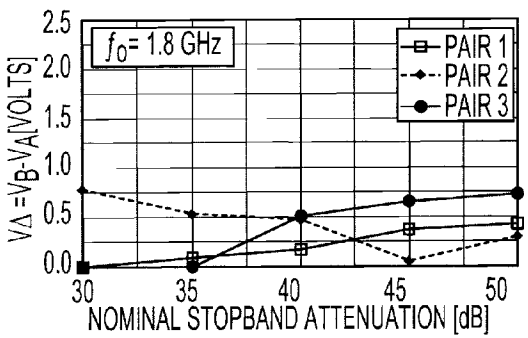

Three of the frequency-agile, first-order, absorptive-pair bandstop filter stages of the preceding section were connected in cascade by two 52.7Ω microstrip lines, each approximately 30° long at 2 GHz, resulting in the integrated third-order, six-resonator absorptive bandstop filter shown in FIG. 8. Superimposed plots of the measured characteristics of the filter are shown in FIG. 9, where the filter has been tuned to attenuation levels of 30, 35, 40, 45, and 50 dB at operating frequencies of 1.8, 2.0, and 2.2 GHz by bias voltages shown in FIG. 10. Stopband bandwidths are all tuned to 60 MHz and the resulting absolute 3 dB bandwidths are all less than 390 MHz.

Referring again to FIGS. 1A-B, the preferred embodiment of a first-order version of the invention takes the form of a method of tuning the stopband attenuation level of a tunable absorptive bandstop filter comprised of an input and an output port. A first signal path composed of a transmission line couples the input port to the output port; while a first tunable resonance is coupled to a first region of the transmission line, a second tunable resonance is coupled to a second region on the transmission line, and the two tunable resonances are coupled to each other, forming a second signal path. The attenuation level of the filter's stopband is tuned by adjusting the resonant frequencies of the two resonances on opposing sides of the optionally tunable nominal central operating frequency $f_o$, of the stopband, where the term "resonance" could refer to the fundamental resonant mode of a physical resonator or to any one of many different resonant modes that a physical resonator might have.

It is noted that although actual couplings could be realized by any type of coupling—such as direct connection, predominately electric field (eg., gap, capacitive, or end-coupled-line) coupling, or predominately magnetic field (i.e., loop, inductive, mutual inductive, transformer, or edge-coupled-parallel-line) coupling—for illustration purposes, couplings have been represented in FIG. 1A by ideal admittance inverters. And, although resonances could be realized in a wide variety of ways—such as by lumped-element circuits including both capacitors and inductors, single-mode or multiple-mode distributed-element transmission line circuits of various electrical lengths (such as quarter-wavelength, half-wavelength, or full-wavelength) and employing various technologies (such as waveguide, microstrip line, and dielectric resonator), and combined lumped/distributed circuits—for illustration purposes, resonances have been represented in FIG. 1B by parallel lumped-element inductor-capacitor-resistor (LCR) resonators with resonant frequencies $f_p$ and $f_m$.

The invention encompasses all absorptive-notch-filter circuit topologies whose absolute bandwidths are relatively independent of the adjustable level of attenuation within a range of attenuation levels. In addition, the present invention encompasses circuit topologies that can be fully passive or include amplifiers, that can be reciprocal or non-reciprocal, that can have cascaded and/or intrinsic higher-order implementations, that can have from zero to several 3 dB-hybrid or direction couplers, and that have fixed or tunable operating frequencies. Also, the tuning elements that enable the tuning of the resonant frequencies of the filter resonators could be of any type or combination of types, including predominately capacitive tuning elements, such as varactor diodes, ferroelectric (e.g., Barium Strontium Titanate or BST) varactors, microelectromechanical (MEM) varactors. switched capacitor networks, and manual or motor-controlled tunable capacitors, or predominately inductive tuning elements. Further these tuning elements could be actuated by any method, including electrical means, using voltages or currents or electric fields or magnetic fields, or mechanical means.

While the invention includes the capability to tune the operating frequency (nominal center frequency of the stopband), in which case the description "frequency-agile" would apply, the invention also encompasses situations where the operating frequency is fixed, which would potentially enable the largest possible tuning range of stopband attenuation level to be realized.

Any of the resonant components discussed above could be incorporated in the ground plane of a predominately microstrip circuit as coplanar waveguide types of resonators and coupled to a microstrip or coplanar waveguide type-of transmission line and/or other components on the substrate's upper surface, or visa versa. Such embodiments of the invention could be termed "photonic bandgap" or "defected ground-plane" embodiments.

The foregoing description details certain embodiments of the invention. It will be appreciated, however, that no matter how detailed the foregoing appears in the text, the invention can be practiced in additional ways. It should also be noted that the use of particular terminology when describing certain features or aspects of the invention should not be taken to imply that the terminology is being re-defined herein to be restricted to include any specific characteristics of the features or aspects of the invention with which that terminology is associated. Further, numerous applications are possible for devices of the present disclosure. It will be appreciated by those skilled in the art that various modifications and changes may be made without departing from the scope of the invention. Such modifications and changes are intended to fall within the scope of the invention, as defined by the appended claims.

What is claimed as new and desired to be protected by Letters Patent of the United States is:

1. A method of tuning the stopband attenuation of an absorptive bandstop filter, wherein said absorptive bandstop filter has at least a first and second resonator, wherein said first resonator includes a first tuning element and exhibits a first resonant frequency and wherein said second resonator includes a second tuning element and exhibits a second resonant frequency, and wherein said tuning elements are used to adjust said corresponding resonant frequencies, comprising:

adjusting said first resonant frequency by means of said first tuning element; and adjusting said second resonant frequency by means of said second tuning element, wherein both said resonant frequencies are coordinated in order to obtain a selected stopband attenuation level and to thereby realize a frequency-selective variable attenuator, and fixing the operating frequency of said filter at a specific value in order to realize an expanded tuning range of stopband attenuation.

2. The method of claim 1, wherein said first tuning element is a varactor whose capacitance is adjusted by a first bias voltage, wherein said second tuning element is a varactor whose capacitance is adjusted by a second bias voltage, and wherein said bias voltage adjustments are coordinated in order to obtain a selected stopband attenuation level.

3. The method of claim 1, wherein said resonators are incorporated in a ground plane of a predominately microstrip circuit to thereby form coplanar waveguide resonators, and further comprising coupling the waveguide resonators to a microstrip or coplanar waveguide transmission line.

4. The method of claim 1, wherein the resonators are at least partially comprised of microstrip transmission lines.

5. The method of claim 1, wherein said absorptive bandstop filter is an absorptive-pair bandstop filter.

6. The method of claim 1, further comprising a plurality of said absorptive bandstop filters in a cascade configuration.

7. The method of claim 1, further comprising selecting the fixed value of the operating frequency using said tuning elements to thereby realize a frequency-agile frequency-selective variable attenuator.

* * * * *